US007467671B2

(12) United States Patent
Savignat et al.

(10) Patent No.: US 7,467,671 B2
(45) Date of Patent: Dec. 23, 2008

(54) DRILL BIT WITH PROTECTION MEMBER

(75) Inventors: Jean-Michel Claude Gaston Savignat, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 125 days.

(21) Appl. No.: 10/580,710

(22) PCT Filed: Nov. 26, 2004

(86) PCT No.: PCT/EP2004/053125

§ 371 (c)(1),
(2), (4) Date: May 25, 2006

(87) PCT Pub. No.: WO2005/052301

PCT Pub. Date: Jun. 9, 2005

(65) Prior Publication Data

US 2007/0095574 A1 May 3, 2007

(30) Foreign Application Priority Data

Nov. 28, 2003 (EP) ..... 03104435

(51) Int. Cl.
*E21B 10/46* (2006.01)
*E21B 37/00* (2006.01)

(52) U.S. Cl. ..... 175/57; 175/267; 175/325.1; 166/174

(58) Field of Classification Search ..... 166/170, 166/174; 175/263, 267, 325.1, 57
See application file for complete search history.

(56) References Cited

U.S. PATENT DOCUMENTS 2,427,052 A * 9/1947 Grant ..... 175/269
2,438,673 A * 3/1948 McMahan ..... 175/267
2,857,141 A * 10/1958 Carpenter ..... 175/270
3,051,255 A * 8/1962 Deely ..... 175/265
3,289,760 A * 12/1966 Kammerer ..... 166/290

(Continued)

FOREIGN PATENT DOCUMENTS

CA 2351849 6/2000

(Continued)

OTHER PUBLICATIONS

International Search Report PCT/EP2004/05053125 dated May 13, 2005.

*Primary Examiner*—Shane Bomar

(57) ABSTRACT

A method is provided for removing a body of selected material from the interior of a casing extending into a borehole formed in an earth formation. The method comprises lowering a drill bit for further drilling of the borehole, into the casing, the drill bit having a longitudinal axis of rotation during operation, the drill bit comprising rock cutting means, at least one protection member for protecting the inner surface of the casing from contact with the rock cutting means, each protection member being adapted to remove said selected material from the interior of the casing and being radially movable towards the inner surface of the casing, and control means for applying a radially outward force of controlled magnitude to the protection member. The drill bit is rotated in the casing, and the control means is operated so as to apply said radially outward force of controlled magnitude to the protection member.

17 Claims, 4 Drawing Sheets

U.S. PATENT DOCUMENTS

| | | | | | |
|---|---|---|---|---|---|
| 4,031,972 | A | * | 6/1977 | Burg | 175/263 |
| 4,545,441 | A | | 10/1985 | Williamson | 175/329 |
| 4,809,779 | A | * | 3/1989 | Ledyashov et al. | 166/173 |
| 4,809,793 | A | * | 3/1989 | Hailey | 175/265 |
| 4,842,083 | A | * | 6/1989 | Raney | 175/325.4 |
| 5,074,366 | A | * | 12/1991 | Karlsson et al. | 175/76 |
| 5,141,063 | A | * | 8/1992 | Quesenbury | 175/267 |
| 5,788,000 | A | * | 8/1998 | Maury et al. | 175/325.1 |
| 6,176,328 | B1 | * | 1/2001 | Caraway et al. | 175/325.5 |
| 6,189,631 | B1 | * | 2/2001 | Sheshtawy | 175/284 |
| 6,397,958 | B1 | * | 6/2002 | Charles et al. | 175/391 |
| 7,036,611 | B2 | * | 5/2006 | Radford et al. | 175/57 |
| 2002/0166703 | A1 | | 11/2002 | Presley et al. | 175/391 |
| 2003/0155155 | A1 | * | 8/2003 | Dewey et al. | 175/57 |
| 2003/0201125 | A1 | | 10/2003 | Raney | 175/21 |

FOREIGN PATENT DOCUMENTS

| | | |
|---|---|---|
| EP | 0869256 | 10/1998 |
| EP | 1270868 | 1/2003 |
| WO | 02/079604 | 10/2002 |
| WO | 2004/104361 | 12/2004 |

* cited by examiner

DRILL BIT WITH PROTECTION MEMBER

PRIORITY CLAIM

The present application claims priority on European Patent Application 03104435.7 filed 28 Nov. 2003.

FIELD OF THE INVENTION

The present invention relates to a method of removing a body of selected material from the interior of a casing extending into a borehole formed in an earth formation and to a drill bit for use in the method.

BACKGROUND OF THE INVENTION

When drilling a borehole in an earth formation, for example to create a well for exploration or production of mineral hydrocarbons, a steel casing is commonly set at a certain stage in the drilling operation in order to secure an already drilled section of the bore hole before drilling deeper. After setting the casing, a drill bit is run through the casing in order to reach the bottom of the hole where the drilling operation can be continued. Running the drill bit through the casing involves a risk of damaging the casing wall, in particular since normally a fresh drill bit is selected that has sharp rock cutters, usually in the form of shear cutters which are much harder than the casing steel and are even capable of cutting through the casing. Since a casing is generally intended to remain in the borehole for a long period of time, it is undesirable to cause casing wall damage.

Moreover, a casing is often cemented in the borehole. Commonly applied cementing procedures require that some cement as well as auxiliary equipment such as cementing plugs remain inside the casing shoe. This must be drilled out in order to expose the bottom of the borehole for continued drilling. However, drilling out the remaining cement and auxiliary equipment from the casing involves the risk of damaging the casing with the rock cutters of the drill bit. This is particularly so if it is desired to leave as little as possible remains of cement in the casing, for example if the lower end portion of the casing is to receive the upper end portion of another casing or liner in sealing engagement.

Thus there is a need for an improved method of removing a body of selected material from the interior of a wellbore casing, which method overcomes the aforementioned problems.

SUMMARY OF THE INVENTION

The present inventions include a method comprising:

a) lowering a drill bit for further drilling of the borehole, into the casing, the drill bit having a longitudinal axis of rotation during operation, the drill bit comprising rock cutting means, at least one protection member for protecting the inner surface of the casing from contact with the rock cutting means, each protection member being adapted to remove said selected material from the interior of the casing and being radially movable towards the inner surface of the casing, and control means for applying a radially outward force of controlled magnitude to the protection member;

b) rotating the drill bit in the casing; and c) operating the control means so as to apply said radially outward force of controlled magnitude to the protection member.

The present inventions also include a drill bit for drilling a borehole into an earth formation, the drill bit being adapted to remove a body of selected material from the interior of a casing extending into the borehole, whereby during operation the drill bit has a longitudinal axis of rotation, the drill bit comprising rock cutting means, at least one protection member for protecting the inner surface of the casing from contact with the rock cutting means, each protection member being adapted to remove said selected material from the interior of the casing and being radially movable towards the inner surface of the casing, and control means for applying a radially outward force of controlled magnitude to the protection member.

BRIEF DESCRIPTION OF THE DRAWINGS

Some embodiments of the invention will be described hereinafter in more detail and by way of example with reference to the accompanying drawings in which.

DETAILED DESCRIPTION OF THE INVENTION

Figure 1:
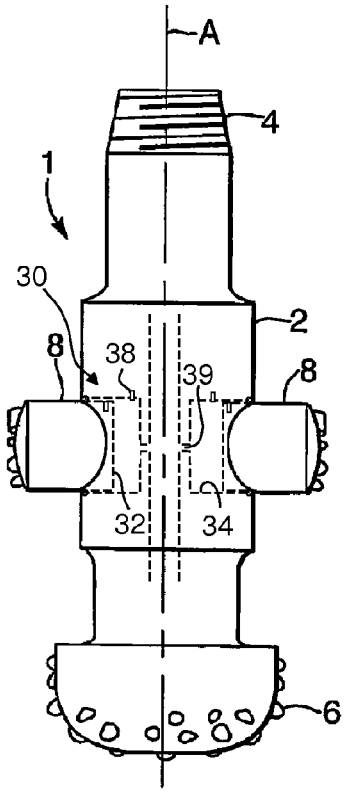
FIG. 1 schematically shows a drill bit for use in the method of the invention.

In the drawings, like reference numerals refer to like parts.

Referring to FIG. 1 there is shown a drill bit 1 for drilling a borehole in an earth formation, the drill bit 1 having a longitudinal axis of rotation (indicated by reference sign A) during drilling. The drill bit includes a cylindrical bit body 2, a connector portion 4 for connecting the drill bit 1 to a drill string (not shown), a pilot bit section 6 arranged at the lower end of the drill bit, and reamer arms 8 which are movable between a radially retracted position and a radially extended position. In an exemplary embodiment, each reamer arm 8 is operable by a piston/cylinder assembly 30 (shown in phantom) incorporated in the bit body 2. Each piston/cylinder assembly 30 comprises a piston 32 in a cylinder 34. A shear pin 38 (shown sheared in FIG. 1) is provided between piston 30 and cylinder 34. In preferred embodiments, movement of pistons 32 is controlled by the pressure of drilling fluid pumped from surface into the drill string and into cylinders 34 via passages 39. Each reamer arm 8 is temporarily retained in its retracted position by shear pin 38, which prevents radially outward movement of the reamer arm 8. The shear pin is designed to break at a threshold fluid pressure exerted to the piston/cylinder assembly by drilling fluid pumped into the drill string.

Figure 2:
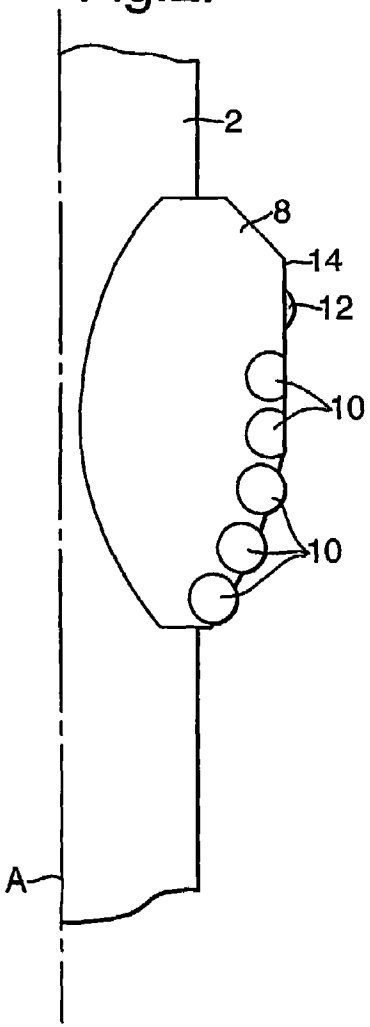
FIG. 2 schematically shows a reamer arm of the drill bit.

The reamer arm 8 is shown in more detail in FIG. 2, indicating a plurality of rock cutters 10 and a protection member 12 provided at a radially outer surface 14 of the reamer arm 8. The protection member 12 protrudes radially beyond the rock cutters 10, that is to say the protection member 12 is over-gauged relative to the nominal drilling diameter of the drill bit 1. The protection member 12 preferably has a blunt shape, for example a rounded shape or a flat shape with a chamfer. Thus the protection member 12 provides a standoff for the rock cutters 10 relative to the inner surface of the casing and thereby prevents the rock cutters 10 from damaging the casing inner surface.

Furthermore, the protection member 12 is sufficiently wear-resistant to effectively clean the casing from undesired remains such as cement, but is of a significantly lower hardness than the rock cutters 10. In this manner it is achieved that the protection member 12 quickly wears away during further drilling of the borehole with the drill bit 1 in order that the protection member 12 does not hamper such further drilling. Suitably the protection member 12 may be made of tungsten-carbide or hardened and/or heat-treated steel. These materials are sufficiently wear resistant to provide the desired standoff and protection of the casing, but vanish quickly during drilling into the rock formation. The degree of wear-resistance of tungsten-carbide can be adapted to circumstances by modifying the amount of cobalt in the alloy and/or by modifying the particle size distribution of the alloy material.

Instead of applying a protection member adapted to wear away during drilling into the rock formation, a protection member can be applied which is radially retractable relative to the reamer arm 8 or relative to the rock cutters 10.

The protection member 12 is axially displaced from the rock cutters 10 in upward direction, i.e. in the direction opposite to the drilling direction of the drill bit 1. Thus the protection member 12 trails the rock cutters 10 and protects the casing inner surface until the rock cutters 10 are out of the casing during cleaning a lower end portion of the casing.

The protection member prevents contact between the rock cutting means and the inner surface of the casing, and further that the protection member does not cause any damage to the inner surface of the casing by virtue of the protection member being moved radially outward at a controlled force. Thus the protection member removes the undesired material from the interior of the casing in a safe manner.

Suitably the drill bit comprises a bit body and a reamer arm movable in radial direction relative to the axis of rotation, wherein the rock cutting means and each protection member are provided at the reamer arm, and wherein step c) comprises operating the control means so as to move the reamer arm in radially outward direction relative to the axis of rotation.

By radially extending the reamer arm, the protection member scrapes against the inside wall of the casing thereby cleaning the casing without the risk of the rock cutters damaging the casing.

Preferably the control means includes a pump for pumping drilling fluid to the drill bit, and wherein step c) comprises operating the pump so as to pump drilling fluid at a controlled flow rate to the drill bit.

In order to gradually remove the undesired material from the interior of the casing, suitably the drill bit is axially moved through the casing simultaneously with steps b) and c).

Figure 3:
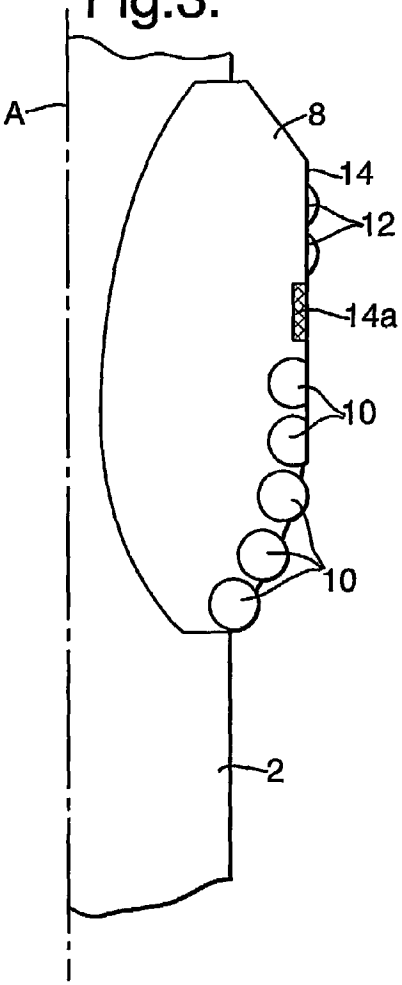
FIG. 3 schematically shows a first alternative reamer arm for use in the drill bit.

In FIG. 3 another embodiment of the reamer arm 8 is shown, whereby the reamer arm 8 is additionally provided with a permanent gauge-protecting area 14*a* of a hard material.

Figure 4:
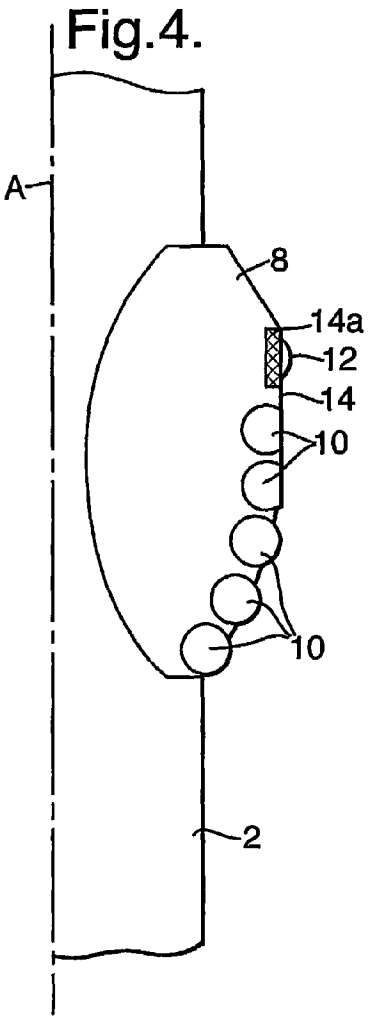
FIG. 4 schematically shows a second alternative reamer arm for use in the drill bit.

In FIG. 4 another embodiment of the reamer arm 8 is shown, wherein the protection member 12 is arranged on top of the gauge-protecting area 14*a*. This arrangement has the advantage that the reamer arm 8 can be of a relatively small cross-sectional dimension. Suitably the gauge-protecting area 14*a* is integrally formed with the protection member 12, and is formed as a layered structure. As shown in the Figures, the outer surface of the protection member 12 has a positive exposure in radial and axial upward direction relative to the rock cutters 10 and the gauge protection.

Figure 5A:
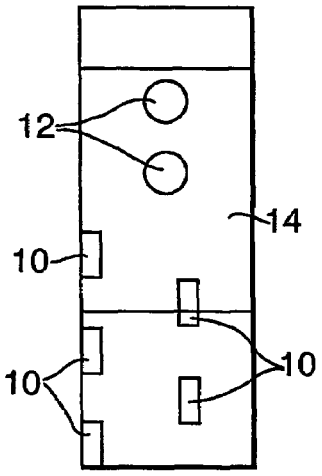
FIGS. 5*a*-5*d* show various possible arrangements of rock cutters and protection members on the reamer arm.
Figure 5B:
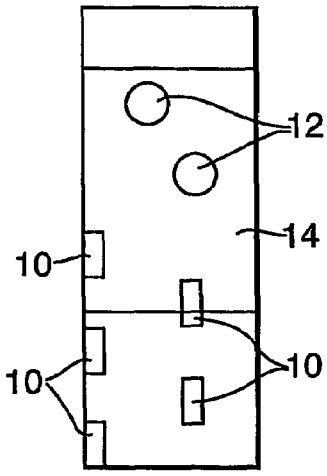
Figure 5C:
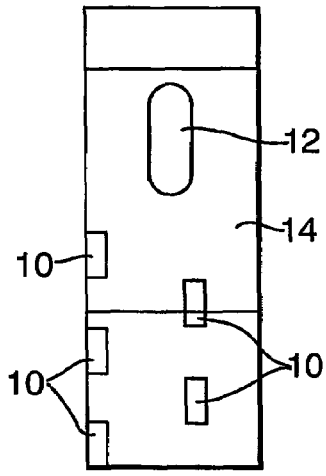
Figure 5D:
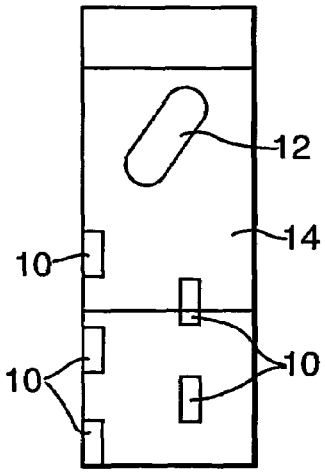

In FIGS. 5*a*-5*d* are schematically shown various arrangements of the rock cutters 10 and protection members 12 on the outer surface 14 of the reamer arm 8. In the arrangements of FIGS. 5*a* and 5*b* two protection members 12 are provided above the rock cutters 10. In FIGS. 5*c* and 5*d* the protection member 12 is an elongate member, either aligned with axis of rotation A (FIG. 5*c*) or at an angle relative to axis A (FIG. 5*d*). The elongate members are formed of cylindrical inserts having essentially spherical ends.

Figure 6:
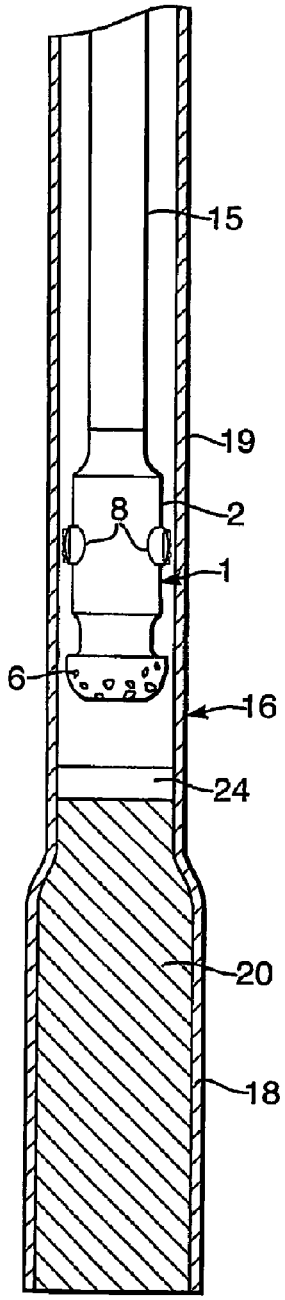
FIG. 6 schematically shows the drill bit of FIG. 1 lowered in a casing during an initial stage of cleaning the interior of the casing.

Referring further to FIG. 6 there is shown the drill bit 1 connected to the lower end of a drill string 15, during lowering thereof in a casing 16 extending into a wellbore (not shown) formed in an earth formation. The casing 16 has a lower end section 18 (hereinafter referred to as "bell section") of larger internal and external diameter than the remainder section 19 of the casing 16. The bell section 18 is filled with a body of hardened cement 20 as a result of a cementing operation whereby cement is pumped via the casing into the annular space between the casing 16 and the borehole in order to fix the casing 16 in the borehole. Furthermore, a cementing packer 24 is arranged on top of the cement body 20.

Figure 7:
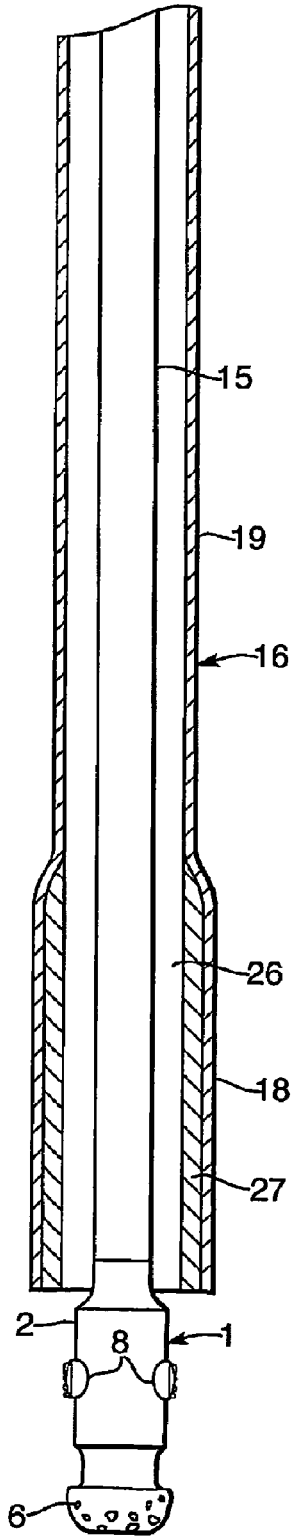
FIG. 7 schematically shows the drill bit during a further stage of cleaning the interior of the casing.

In FIG. 7 there is shown the drill bit 1 and casing 16 after the drill bit has been operated to drill a longitudinal bore 26 through the cement body 20 thereby defining a remaining annular cement portion 27.

Figure 8:
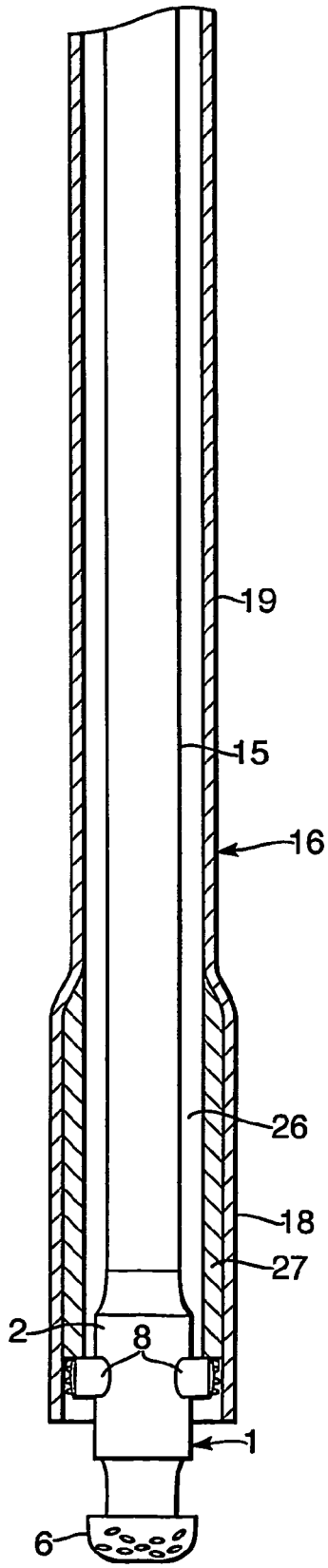
FIG. 8 schematically shows the drill bit during a yet further stage of cleaning the interior of the casing.

In FIG. 8 there is shown the drill bit 1 and casing 16 during cleaning the interior of the casing 16 from the annular cement portion 27 and any remains of the cementing packer 24.

Figure 9:
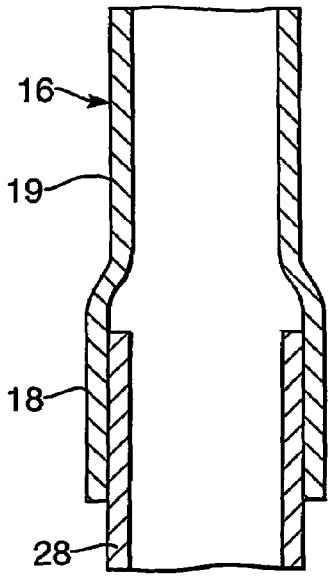
FIG. 9 schematically shows the lower end of the casing after being connected to a further casing.

In FIG. 9 there is shown the bell section 18 after being cleaned with the method of the invention, and wherein a further casing 28 extends into the bell section 18. The further casing 28 has been radially expanded against the inner surface of the bell section 18 using a known expansion technique.

In an another embodiment the drill bit is first operated to drill a longitudinal bore in said body of selected material thereby forming an annular remainder portion of the body of selected material, and subsequently the drill bit is operated to remove the annular remainder portion whereby the drill bit is axially moved through said longitudinal bore.

It is preferred that the protection member suddenly or gradually wears away when the drill bit is operated to further drill the borehole so that the borehole can be drilled with its nominal drilling diameter as dictated by the rock cutting means without being obstructed by the protection member.

In an another embodiment, the protection member is sacrificial when it contacts the subterranean formation. This can be achieved for instance by providing the protection member with a material having a balanced wear resistance that is on one hand sufficiently wear resistant to prevent the rock cutting means to contact the casing inner surface and on the other hand wearable against the subterranean formation once the drill bit is outside the casing and drills the formation.

During normal operation the drill bit 1 is lowered into the casing 16 (FIG. 6) with the reamer arms retained in their retracted positions by the respective shear pins. Upon contacting the cementing packer 24, the drill string 15 is rotated whereby the pilot bit section 6 drills out the cementing packer 24, and furthermore drills through the cement body 20 to create the longitudinal bore 26.

The drill string 15 is then further lowered until the drill bit extends below the bell section 18 of the casing 16 (FIG. 7). Subsequently the pump rate of drilling fluid is temporarily increased in order to break the shear pins and thereby to allow the reamer arms 8 to move radially outward.

In a next step the pump rate is maintained at a level whereby each piston/cylinder assembly exerts a moderate radially outward force to the respective reamer arm 8. The drill string is simultaneously rotated and gradually moved upwardly. As the drill bit 1 moves upwardly through the longitudinal bore 16, the rock cutters 10 enlarge the longitudinal bore 16 and the protection members 12 of the respective reamer arms 8 scrape against the annular cement portion 27 which is thereby gradually removed. Since the force at which the protection members 12 are pushed radially outward is controlled at a moderate magnitude, there is no risk of significant damage to the inner surface of the casing 16 due to the scraping action of the protection members 12. At the same time the protection members 12, by virtue of their radial standoff, prevent the sharp rock cutters 10 to contact the casing 16.

Thus, the drill bit of the invention is particularly advantageous cleaning a casing shoe from cement remnants. The pilot bit section and/or the rock cutters of the reamer arms drill out a major part of the body of cement, and the protection members clean the inner surface of the casing in a safe manner by virtue of the standoff between the rock cutters and the casing wall. The protection member is suitably formed as a blunt cutting element. Also, the protection member can be formed as a scraper.

In an alternative mode of operation, the drill bit is lowered through the casing until the wiper plug (if present) or the cement body is reached. Drilling out is then started with the reamer arms in their retracted position until the bell section of the casing is reached. The drilling fluid pressure is then increased to above the selected pressure so as to break the shear pins and to allow the reamer arms to move radially outward. The protection members thereby engage with the bell section so as to clean the bell section from cement remnants. When the drill bit finally moves to below the casing bell section, the reamer arms can optionally be fully expanded in order to further drill and/or ream the borehole.

During such further drilling the protection members contact the subterranean rock formation and thereby wear at a high wear-rate so that possible negative effects of the purposively poor cutting properties of the protection members on the drilling performance, is mitigated.

During the normal mode of operation, the transition section between the bell section and the remainder casing section converges to a smaller diameter in upward direction. Such damage can be caused by the protection members as these move from the bell section into the remainder casing section if the protection members have somewhat sharp edges due to minor wear of the protection members during cleaning of the bell section.

We claim:

1. A drill bit for drilling a borehole into an earth formation, the drill bit being adapted to remove a body of selected material from the interior of a casing extending into the borehole, whereby during operation the drill bit has a longitudinal axis of rotation, the drill bit comprising rock cutting means, at least one protection member for protecting the inner surface of the casing from contact with the rock cutting means, each protection member being sufficiently wear-resistant to effectively clean the casing of said selected material but of lower hardness than said rock cutting means and being radially movable towards the inner surface of the casing, and control means for applying a radially outward force of controlled magnitude to the protection member;

wherein the drill bit further comprises a reamer arm movable in a radial direction relative to said axis of rotation, wherein the rock cutting means and each protection member are provided at the reamer arm;

wherein the control means is arranged to move the reamer arm in radial direction relative to said axis of rotation; and wherein the reamer arm is provided with gauge protection means for protecting the reamer arm against wear during further drilling of the borehole with the drill bit, and wherein the protection member is arranged on top of the gauge protection means at the radially outward side thereof.

2. The drill bit of claim 1, wherein the reamer arm is provided with releasable locking means for temporarily locking the reamer arm in a radially retracted position thereof.

3. The drill bit of claim 2, wherein the locking means is releasable by the action of the control means.

4. The drill bit of claim 1, wherein the protection member is formed as an insert in the reamer arm or as an integral part of the reamer arm.

5. The drill bit of claim 1, wherein the gauge protection means and the protection member are integrally formed.

6. The drill bit of claim 1, wherein the protection member has a rounded portion protruding radially outward from the reamer arm.

7. The drill bit of claim 1, wherein the protection member is formed as a scraper for scraping against said body of selected material.

8. The drill bit of claim 1, wherein the protection member is adapted to substantially vanish due to wear during drilling into the earth formation with the drill bit.

9. The drill bit of claim 1, wherein said body of selected material which is to be removed from the casing includes a body of cement located in a lower end portion of the casing.

10. A method of removing a body of selected material from the interior of a casing extending into a borehole formed in an earth formation, the method comprising:

a) lowering a drill bit for further drilling of the borehole, into the casing, the drill bit being constructed in accordance with claim 9;

b) rotating the drill bit in the casing; and c) operating the control means so as to apply said radially outward force of controlled magnitude to the protection member.

11. The method of claim 10, whereby the drill bit comprises a reamer arm movable in radial direction relative to said axis of rotation, wherein the rock cutting means and each protection member are provided at the reamer arm, and wherein step c) comprises operating the control means so as to move the reamer arm in radially outward direction relative to the axis of rotation.

12. The method of claim 10, wherein the control means includes a pump for pumping drilling fluid via a drill string to the drill bit, and wherein step c) comprises operating the pump at a controlled pump rate.

13. The method of claim 10, wherein the drill bit is axially moved through the casing simultaneously with steps b) and c).

14. The method of claim 13, further comprising: before steps b) and c), operating the drill bit to drill a longitudinal bore in said body of selected material thereby forming an annular remainder portion of the body of selected material, and wherein during steps b) and c) the drill bit is axially moved through said longitudinal bore so as to remove the annular remainder portion.

15. The method of claim 14, wherein during steps b) and c) the drill bit is axially moved in an upward direction through said longitudinal bore.

16. The method of claim 10, wherein the body of selected material includes a body of cement located in a lower end portion of the casing.

17. The method of claim 10, wherein the body of selected material extends into a lower end portion of the casing, said lower end portion having a larger inner diameter than a remainder portion of the casing.

* * * * *